US008997421B2

(12) United States Patent
Del Pino Garcia et al.

(10) Patent No.: US 8,997,421 B2
(45) Date of Patent: Apr. 7, 2015

(54) HOLDING UNITS FOR STAY IN PLACE MOLDS

(75) Inventors: Pedro Del Pino Garcia, Caguas, PR (US); Pedro Quiles Pérez, Carolina, PR (US)

(73) Assignee: Jose Javier Cerame, San Juan, PR (US)

( * ) Notice: Subject to any disclaimer, the term of this patent is extended or adjusted under 35 U.S.C. 154(b) by 236 days.

(21) Appl. No.: 13/135,485

(22) Filed: Jul. 7, 2011

(65) Prior Publication Data

US 2011/0265413 A1 Nov. 3, 2011

Related U.S. Application Data

(63) Continuation of application No. 12/633,416, filed on Dec. 8, 2009, now abandoned.

(51) Int. Cl.

| | |
|---|---|
| ***E04B 2/94*** | (2006.01) |
| ***B28B 19/00*** | (2006.01) |
| ***E04B 1/16*** | (2006.01) |
| ***E04B 2/86*** | (2006.01) |

(52) U.S. Cl.

CPC ..... *B28B 19/00* (2013.01); *E04B 1/161* (2013.01); *E04B 2/8635* (2013.01); *E04B 2/8647* (2013.01)

(58) Field of Classification Search

CPC ... E04B 2002/86; E04B 2002/84; E04B 2/02; E04B 2/10; E04B 2/28; E04B 2/30; E04B 2/44; E04B 2/86; E04B 2/8611; E04B 2/8617; E04B 2/8623; E04B 2/8629; E04B 2/8635; E04B 2/8647

USPC ..... 52/422, 424–426, 715, 712, 561, 564, 52/565, 379, 427, 432, 442; 249/38, 40, 249/44, 45, 47, 216

See application file for complete search history.

(56) References Cited

U.S. PATENT DOCUMENTS

| | | | | |
|---|---|---|---|---|
| 4,516,372 | A | 5/1985 | Grutsch | |
| 4,598,519 | A | 7/1986 | Reid | |
| 4,998,393 | A | 3/1991 | Baena | |
| 5,473,849 | A | 12/1995 | Jones, Jr. et al. | |
| 5,598,675 | A * | 2/1997 | Pruss | 52/309.4 |
| 5,657,601 | A | 8/1997 | Bean et al. | |
| 5,839,243 | A | 11/1998 | Martin | |
| 6,260,320 | B1 | 7/2001 | Di Lorenzo | |
| 2001/0029717 | A1 * | 10/2001 | Spakousky | 52/405.4 |
| 2002/0116889 | A1 * | 8/2002 | Moore, Jr. | 52/426 |
| 2006/0260239 | A1 * | 11/2006 | Boese et al. | 52/426 |
| 2008/0022619 | A1 | 1/2008 | Scherrer | |
| 2009/0107065 | A1 | 4/2009 | LeBlang | |
| 2009/0313931 | A1 | 12/2009 | Porter | |
| 2011/0314760 | A1 * | 12/2011 | Degen et al. | 52/426 |

* cited by examiner

*Primary Examiner* — William Gilbert

(74) *Attorney, Agent, or Firm* — Hoglund & Pamias, P.S.C.; Roberto J. Rios

(57) ABSTRACT

Stay in place molds for the construction of concrete structures having fiber cement panels held together by multiple holding units is described. The holding units requires a flat rectangular main body; an indentation substantially located at the center of the upper side of the flat rectangular main body; left and right lateral edges perpendicularly located at the lateral sides of the rectangular body and a lower edge perpendicularly positioned at the lower side of the bottom side of the flat rectangular main body. They are selectively distributed at the internal cavity of the molds as a series of columns and rows separated from each other at predetermined distance. The particular structure and its distribution pattern facilitate the uniform contact of the liquid cement mixture and increase the strength and resistance of the structure prepared using the molds.

10 Claims, 7 Drawing Sheets

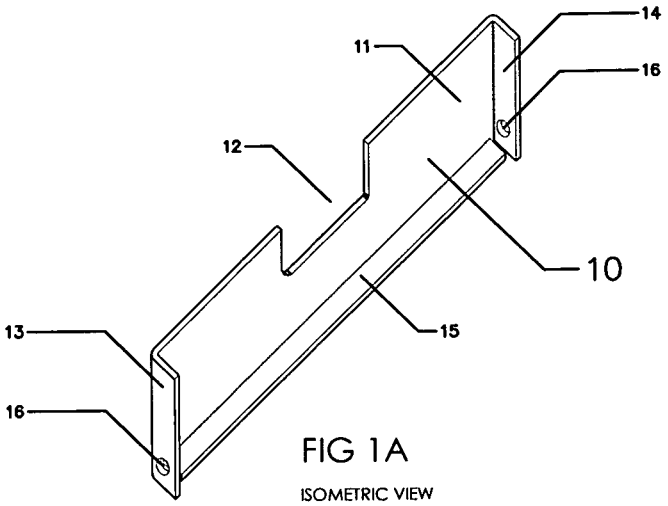
FIG 1A
ISOMETRIC VIEW
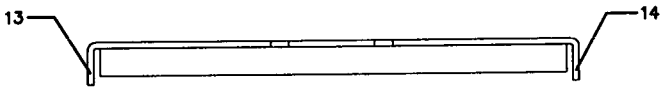
FIG 1B
TOP VIEW
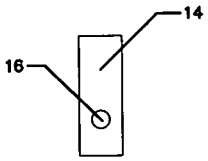
FIG 1C
RIGHT VIEW
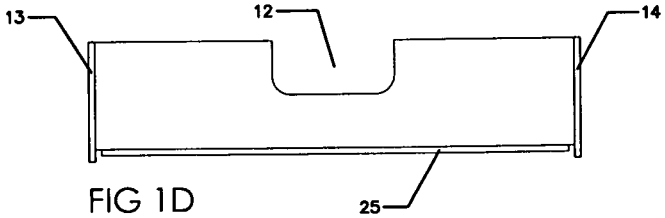
FIG 1D
FRONT VIEW
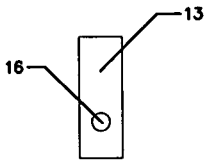
FIG 1E
LEFT VIEW
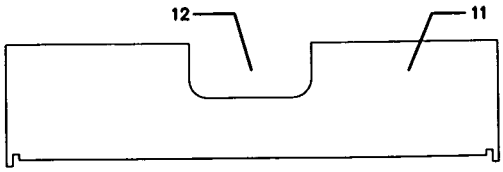
1F
REAR VIEW

ISOMETRIC VIEW

RIGHT VIEW

LEFT VIEW

TOP VIEW

FRONT VIEW

REAR VIEW

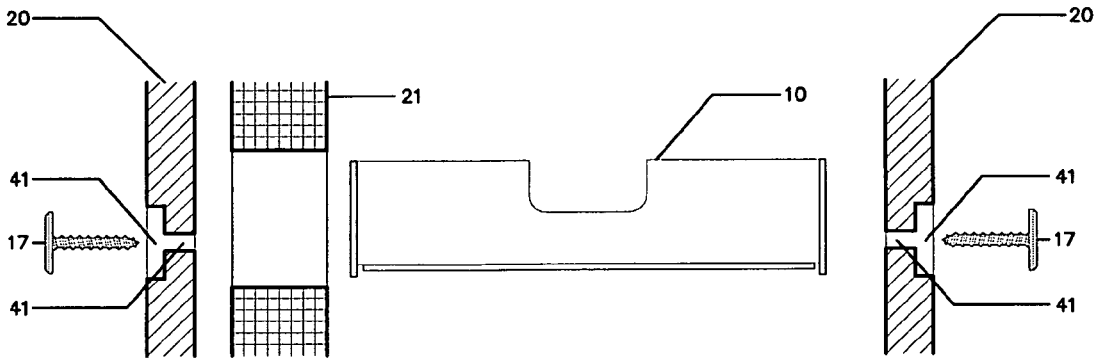
FIG. 6A EXPLODE PANEL ASSEMBLY DETAILS
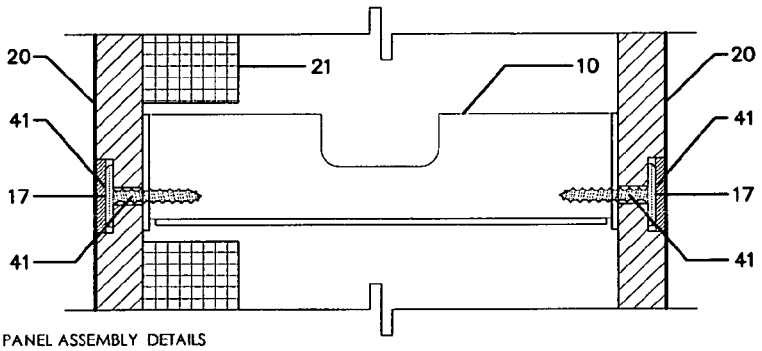
FIG. 6B PANEL ASSEMBLY DETAILS
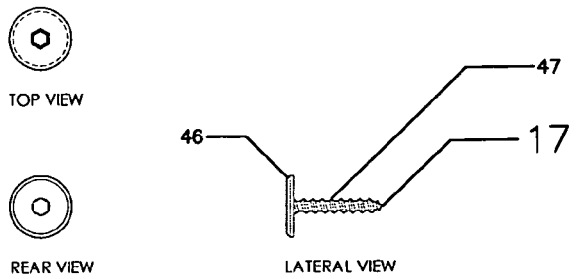
FIG. 6C SCREW DETAILS

HOLDING UNITS FOR STAY IN PLACE MOLDS

This application claims priority under 35 USC 120 to U.S. patent application Ser. No. 12/633,416 filed on Dec. 8, 2009.

TECHNICAL FIELD OF THE INVENTION

This invention relates to stay in place molds for the construction of concrete structures. More particularly, the invention is directed to stay in place construction molds comprising multiple holding units having a particular shape and design that renders monolithic concrete structures of excellent strength.

BACKGROUND OF THE INVENTION

Fiber cement panels, also known as fiber cement boards have been used in the elaboration of stay in place molds useful in the construction of concrete structures. In general terms, two fiber cement panels are vertically positioned and held together in order to create an internal cavity intended to be filled with liquid concrete mixture at the construction site.

The real challenge in the manufacture and use of said molds is to maintain both fiber cement panels held together firmly and to obtain a highly internal pressure resistance at the internal cavity of the form.

In most instances, said fiber cement panels hare held together by means of vertical and horizontal structural components which, are attached internally or externally to the said panels, debilitating the whole structure. Said external components complicate the construction process, requiring external supports in order to counteract or balance the internal pressure created once the liquid cement mixture is poured inside the mold. Similarly, said external components difficult the alignment and proper connection of individual molds, as required in the formation of larger structures.

On the other hand, the use of complicated components assembled through the width of the fiber boards and passing along its internal cavity compromise the firmness and stability of the mold and the strength of the structure constructed with said mold. In the internal section of the mold, said structures occupy a large area of the internal cavity and thus, represents an obstruction that avoid the uniform contact of the liquid concrete mixture, which results in the formation of a non-monolithic, weak concrete structure. On the other hand, regarding the external section of the mold, once the concrete structure is made, it is required to eliminate the external section of such components, which means additional work that can negatively affect the interior of the constructed structure.

Thus, there is a need of stay in place fiber cement molds comprising a holding unit or spacer element, easy to manage, friendly to insert mechanical and electrical construction features and particularly designed to increase the stability of the mold, capable of allow a uniform dispersion of internal pressure of the liquid mixture and to allow the uniform contact of the liquid cement mixture in order to provide concrete structures with excellent strength and resistance.

OBJECTS AND SUMMARY OF THE INVENTION

It is an object of the invention to provide stay in place fiber cement molds capable of holding the fiber cement boards with strong firmness, wherein the holding units are distributed exclusively in small areas of the internal cavity and without having any of their components exposed at the exterior surfaces of the fiber cement boards. Another object of the invention is to provide molds comprising fiber cement boards having excellent resistance to the internal pressure created by the liquid cement mixture, thus capable to stand said internal pressure without the need of any external supports or components.

Yet another object of the invention is to provide a mold wherein the liquid cement mixture is uniformly spread inside its internal cavity, allowing said mixture to form strong monolithic structures. Still another object of the invention is to provide strong fiber cement molds that are able to be firmly interconnected to another mold in order to produce uniform and strong larges sizes concrete structures. Yet another object of the invention is to provide a mold capable of render concrete structures that resists high pressure and heavy weights. In an additional embodiment, another object of the instant invention is to provide a mold comprising fiber cement boards capable of incorporate insulating materials and without the need of disturb the interior of the constructed wall after the cement construction mixture is poured. In a still another object of the invention is to provide a stay in place mold having its exterior surface substantially flat, thus providing a concrete structure already having flat external surfaces. In yet another object of the invention is to provide a mold wherein distance and distribution of re bars may be easily predetermined and established as demanded by a given or particular construction code.

BRIEF DESCRIPTION OF THE DRAWINGS

The foregoing and additional features and characteristics of the embodiments of the present invention will become more apparent from the following detailed description considered with reference to the accompanying drawings, which are used herein in a manner of example only, and wherein:

FIGS. 1A to 1F represent diverse views of the holding unit according to the instant invention.

FIGS. 6A to 6C illustrate the second main step in the method of manufacturing molds requiring holding unit illustrated in FIG. 1, wherein said holding unit are fastened to the fiber cement panels and panel foam.

DETAILED DESCRIPTION OF THE EMBODIMENTS

Figure 2A:
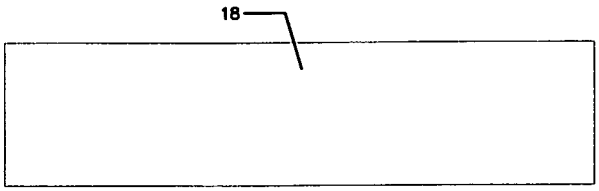
FIG. 2A to 2D represent a method of manufacturing the holding unit illustrated in FIG. 1.
Figure 2B:
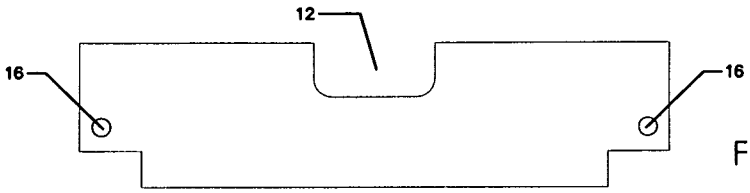
Figure 2C:
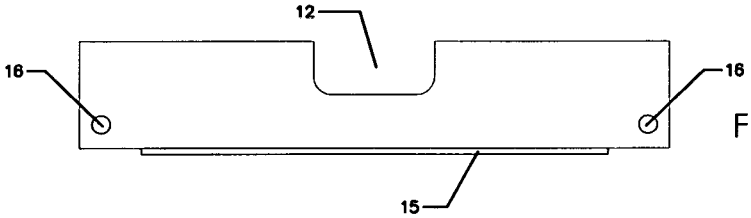
Figure 2D:
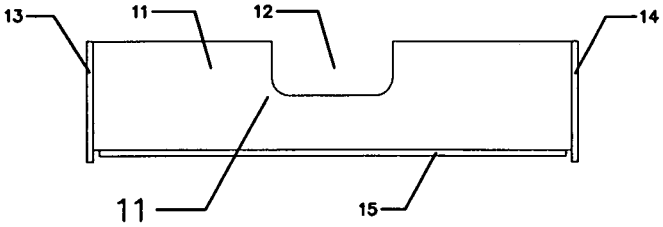
Figure 3B:
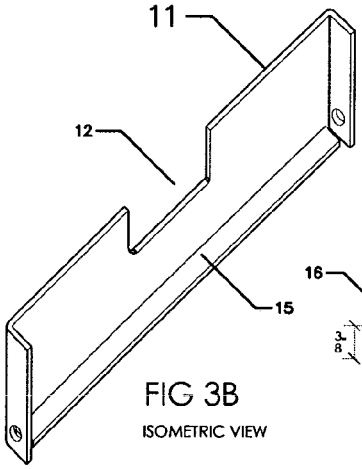
FIG. 3A to 3F represent holding unit illustrated in FIG. 1 with the corresponding preferred dimensions when using in a fiber cement panels of 4 feet per 8 feet.
Figure 3C:
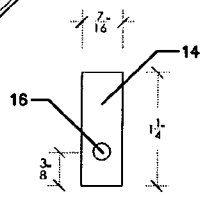
Figure 3E:
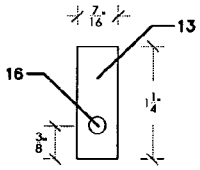
Figure 3A:
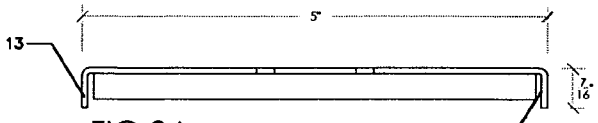
Figure 3D:
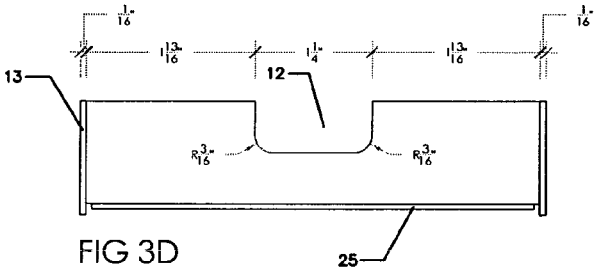
Figure 3F:
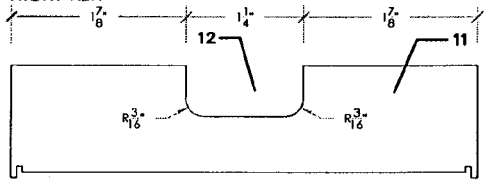

The following detailed description illustrates the invention by way of example and is not limited to the particular limitations presented herein as principles of the invention. This description is directed to enable one skilled in the art to make and use the invention by describing embodiments, adaptations, variations and alternatives of the invention. Potential variations of the limitations herein described are within the scope of the invention. Particularly, the size and shapes of the invention's elements illustrated in the discussion may be varied and still provide molds having different sizes or geometric shapes, that are within the scope of the instant invention.

The instant invention is directed to stay in place molds useful in the construction of concrete structures, such as houses, walls, buildings and the like. Said molds are intended to be placed in the construction site and further filled out with concrete mixture. Once said mixture is dried out; the molds remained as integrated part of the constructed structure. The herein described molds have excellent pressure resistance and strength due to the particular structure and design of the holding units used in its manufacture.

In reference to the drawings, FIG. 1 illustrate the holding unit 10, according to the invention, which has been particularly designed as spacer for the stay in place molds herein described. It comprises a continuous flat, rectangular main body 11, having an indentation 12, substantially at the middle of the upper section of the main body 11. Lateral edges 13 and 14 run alongside the left and right side of the main body 11 respectively and are located perpendicularly to such left and right lateral sides of main body 11, forming a 90 degrees angle. The lower end 15 of the internal holding unit 10 is also located perpendicularly oriented toward the lower side of main body 11. At the lower section of the lateral edges 13 and 14 there is an aperture 16 that provides entering of fastening means 17, when connecting holding unit 10 to the internal surfaces of fiber cements boards 20, as illustrated in FIGS. 6A and 6B.

Internal holding unit 10 may be made of strong, rigid material, preferably a suitable metal such as steel and even more preferably galvanized steel. It may be molded as a single unit or it may be made as illustrated in FIGS. 2A to 2 D, wherein galvanized steel plate 18 is cut off at the middle in order to form indentation 12. Said indentation 12 is used as a support for horizontally positioned re-bars 66, as explained in more detailed later and illustrated in FIG. 7. Perforation at the lower left and right sides of plate 18 creates aperture 16. The internal holding unit 10 may be obtained after cutting off the lower left and right edges of plate 18 and bending the left, right and lower edges of the plate 18 extremes sides or edges in a 90 degrees angle with respect to the axis of the flat rectangular main body 11. The particular dimensions of the internal holding unit 10 may varied depending on different factors such as the size of the desired mold, the width of the structure to be constructed with the mold, the size of horizontal re-bars 66 and vertical re-bars 65 to be introduced in the mold, and other construction specifications dictated by particulars legal constructions codes. Thus, the herein disclosed molds are adaptable to different construction codes requirements.

In a preferred embodiment, when using fiber cement boards 20 with dimensions of a 4 feet×8 feet, the metal plate 18 may have a total length of 6 inches and 1.25 inches height. A particular plate 18 of such dimensions provides an internal holding unit 10 having a main body 11 length of 5 inches, an internal indentation 12 of 1.25 inches long and 0.50 inches in depth; a left and right sides 13 and 14, respectively having a length of 0.44 inches and a lower side 15 having a length of 0.25 inches.

Among the main functions of the holding unit 10 are holding the fiber cement panels 20 parallel to each other; providing excellent structural strength inside the molds capable to withstand extreme internal pressures created by the concrete mixture until it solidifies. Additionally, said holding unit 10 provide support to horizontal re-bars 66 as required by any given particular structural specification and since each holding unit 10 are connected only to the internal surface of the fiber cement panels 20, they provide stay in place molds having a flat external surface ready for painting once a concrete structure is constructed. Holding unit 10 has a physical structure that has been created to render concrete molds having extreme resistance to the internal pressure produce by liquid concrete mixture. Furthermore, holding unit 10 is assembled at the internal cavity 32 of molds in a dispersed and predetermined pattern that uses only near 2 percent of the internal cavity of a mold. Therefore, near 98 percent of the concrete mixture is allow to be in direct contact with itself, which produces an extremely strong concrete structures, capable to resist the weight of additional structures above them, thus allowing the construction of high concrete structures such as buildings. Furthermore, the dispersion pattern in the assembling of the holding unit 10 and the small thickness of said holding unit allows an accommodation of vertical re-bars 65 at a given distance specified by the structural design of the construction; in such a manner that the installation of electrical or mechanical features inside the mold is free of any interferences with said holding units. Similarly, the strength of the resulting walls is much more resistance to earth quake motions and similar external forces, thus increasing the security of said constructions and its inhabitants. Besides, the use of holding unit 10 having a thin main body allows the incorporation of internal reinforcements, if necessary or desired, thus increasing the versatility of the herein disclosed mold.

Figures 4A, 4B, 4C:
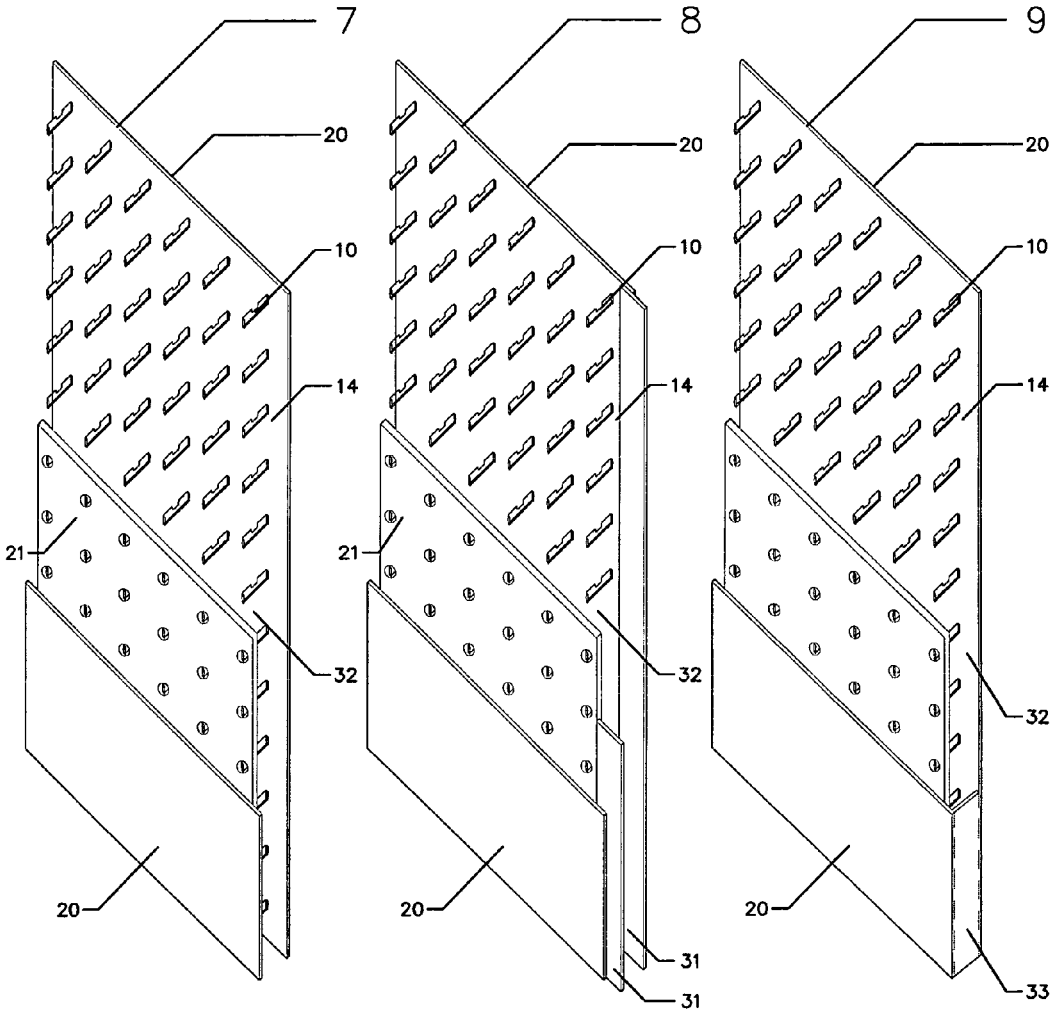
FIG. 4A to 4C illustrate different mold embodiments manufactured using the holding unit illustrated in FIG. 1.

The internal holding unit 10 is useful in the manufacture of stay in place construction mold embodiments 7, 8 and 9 as illustrated in FIG. 4A though 4C, wherein the upper front sections of the molds have been cut off in order to illustrate the internal components of each embodiment. Each mold embodiments 7, 8 and 9 comprises two fiber cement panels 20, positioned parallel one to the other wherein each fiber cement panel 20 has a flat, substantially uniform external surface. The holding units 10 are permanently fastened at the interior cavity 32 of the mold in a predetermined pattern forming a series of multiple columns and rows. Each of said columns is apart from the next one at a predetermined distance. Similarly, each holding unit 10 within a given column is also apart from the next holding unit 10 at a predetermined distance.

The interior section of the mold may include an insulated foam panel 21, having the same dimensions of the fiber cement panels 20. Said optional foam panel 21 may serves as an insulating element and is attached to the internal surface of one of the fiber cement panels 20. Embodiment 7, in FIG. 4A has its lateral sides free and open. Embodiment 8 however, comprises two interconnecting units 31, which are located along the left edges of the internal section of fiber cements boards 20. Fiber cement boards 20, and foam panel 21 are commercially available. Interconnecting units 31 are made of a fiber cement panel 20 that has been cut off at a suitable size. Said interconnection units 31 allow the joining of individual molds in order to constructs larger size walls, as further explained below. Similarly, each mold embodiment 7, 8 and 9 also comprises multiple internal holding units 10, which are distributed in a particular arrangement over the internal surface of fiber cement boards 20. The extremes or ends of each internal holding unit are physically connected only to the internal surfaces of the fiber cement panels 20, thus creating an internal cavity 32.

On the other hand, mold embodiment 9 as illustrated in FIG. 4C has a closing unit 33 enclosing the internal cavity 32 of the mold 9. Said closing unit 33 may be made of fiber cement panel that has been cut off at the convenient size in order to close the internal cavity 32 of the mold 9. Said closing unit 33 may be installed once the mold is already installed at the construction site and previous to fill the internal cavity 32 of the mold 9 with liquid concrete mixture.

Figure 5A:
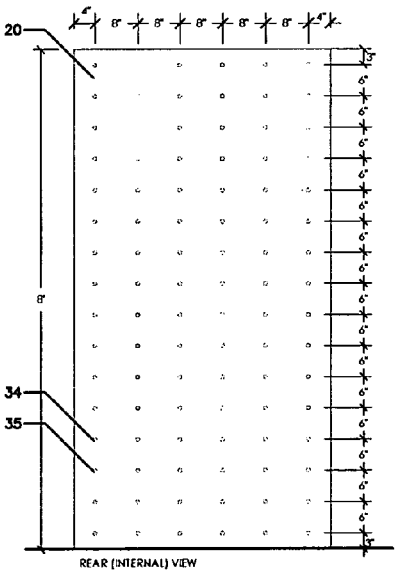
FIG. 5A to 5E illustrate the initial main step in the method of manufacturing molds requiring holding unit illustrated in FIG. 1, wherein the fiber cement panels and panel foam are properly perforated.
Figure 5C:
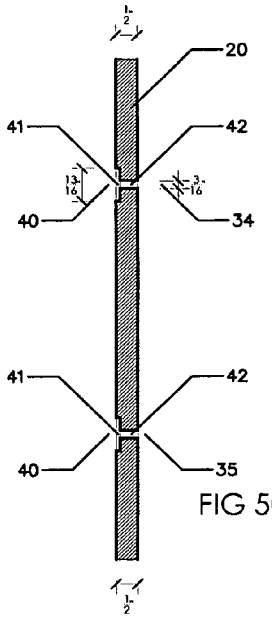
Figure 5B:
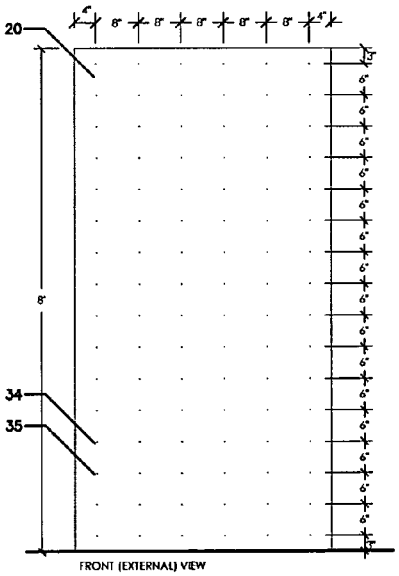
Figure 5D:
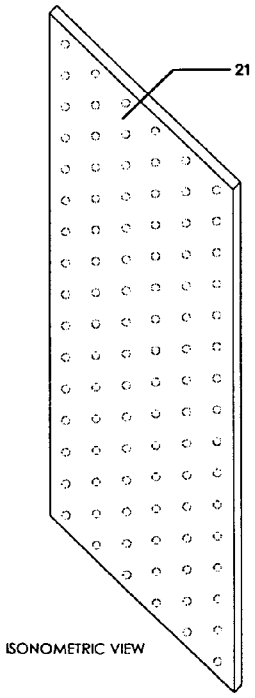

The manufacture of the mold embodiments illustrated FIGS. 4A to 4C is shown in FIGS. 5A to 5E, wherein the initial step is the proper setting of the fiber cement boards 20. Said setting requires a series of perforations in a particular size or shapes and further distributed in a particular pattern of columns (verticals) and rows (horizontal) at a predetermined distance and within a particular surface area of the fiber cement panels 20. Each perforation is intended to provide a place for fastening a holding unit 10, as explained below. Said arrangement is aimed to achieve the maximum strength and resistance of the resulted mold, which must be within the limits established by a given construction code and to properly organize the required horizontally oriented re-bars 66. For instance, as illustrated in FIG. 5A and FIG. 5B, the distance between a given perforation 34 and the following perforation 35 within columns is dictated by the distance between a given horizontal re-bars 66 and the next horizontal re-bars 66 as required by any given construction specification. In the illustrated example such distance is illustrated as six inches.

FIGS. 5A-5D illustrate the initial preparation of a fiber cement panel 20 having particular dimensions of 4 feet per 8 feet; wherein the internal surface of the fiber cement panel 20 that eventually will contain the holding units 10 is delimitated by a left, right, top and bottom sections of a predetermined size of three inches. In the illustrated example, the top and bottom distance is three inches, while the left and right margins are of four inches. Said margins are free of perforations and frame the internal area of the fiber cement panel 20 containing the perforations aligned in columns and rows pattern that will be fastened to the holding unit 10.

Regarding the dimensions of the perforations itself, as shown in FIG. 5C, each perforation 40 comprises a first drill or opening 41 and a second opening 42, which is at substantially the center of opening 41. The first opening 41 has a larger diameter than second opening 42. In a preferred embodiment, first opening 41 has a diameter of 0.75 inches and a depth of 0.12 inches. On the other hand, the second opening 42 has a diameter of 0.187 inches and a length of 0.38 inches. Therefore, the width of the fiber cement board 20 is 0.5 inches; there is a remaining of 0.38 inches not affected by the initial opening 41. The second opening 42, at the center of the first opening 41, passes through the internal surface of the fiber cement board 20 is made with a 0.1875 inches (3/16) inches drill.

After the perforation of a first fiber cement panel 20, an identical perforation pattern is performed in the second fiber cement panel to be used in the same mold. Thus, a mold 7 comprising two fiber cement panels 20 with dimensions of 4 feet×8 feet and with the specifications requiring a six inches separation of horizontally oriented re-bars, there will be a total of 96 perforations on each panel.

Figure 5E:
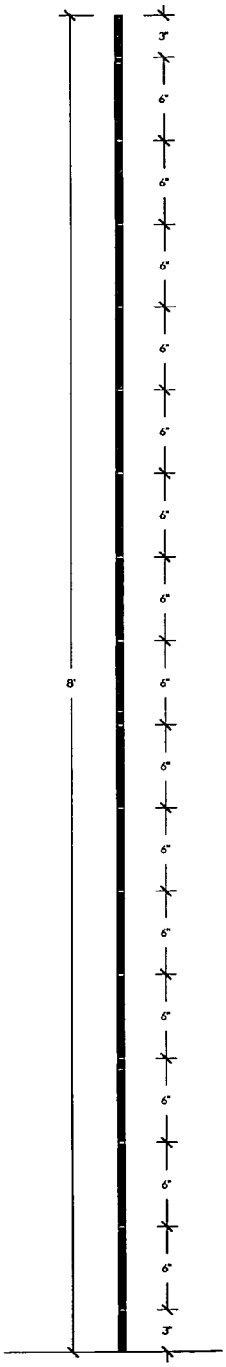

Once the fiber cement panels 20 have been perforated, the optional insulating foam panel 21, if used, is also perforated, wherein the perforations on the foam panel 21 are located at the same position or simulating the same perforation pattern of the perforations of the fiber cement panels 20. However, the perforations on the foam panel 21 have a diameter corresponding to the lateral edge 14 of the holding unit 10, as illustrated in FIG. 5E.

After the perforations on the fiber cement panels 20 and the foam panel 21 are done, the mold is assembled by gluing foam panel 21 on the internal surface of one of the boards 20 and further fastening holding units 10 to each perforation on the internal surface of each one of the fiber cement boards 20, thus creating internal cavity 32. Said assembling is illustrated in FIGS. 6A and 6B. The fastening means used to fast or secure the holding unit 10 to the panels 20 may be any suitable fastening means, such as screws, bolts or rivets, and more particularly preferred is the use of flathead screws 17, having flathead 46 that perfectly fits on the first opening 41 and having a threaded section 47 that fits second opening 42. Once all the fastening means are properly fastened, the external sections of first opening 41 are plastered, thus providing mold 7 with a smooth, flat, finished external surface.

Optionally and depending of the construction needs, interconnecting units 31 may be connected to one of the lateral sides of the mold 7, if necessary, in order to provide a joining mechanism as shown in embodiment 8 illustrated in FIG. 4B, as may be required depending of the size of desired wall under construction.

Figure 7:
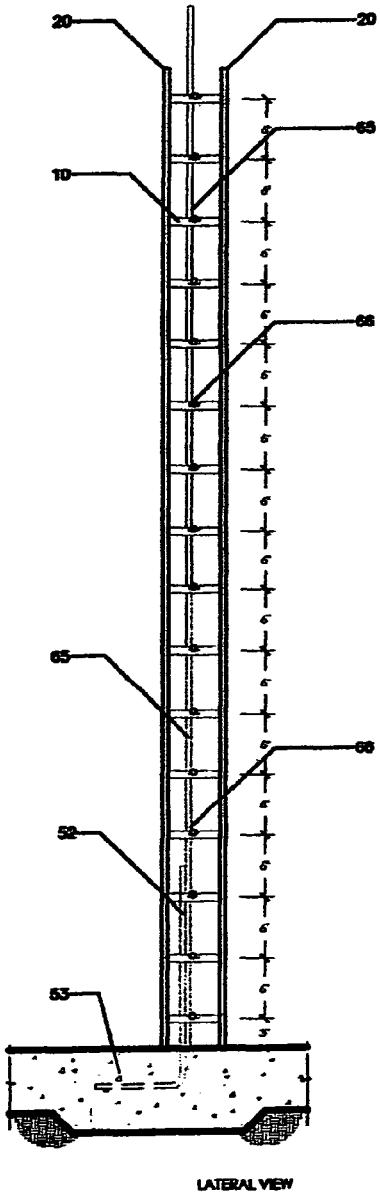
FIG. 7 illustrates a lateral view of the use of a mold according to the instant invention in the construction of a concrete wall.
Figure 8A:
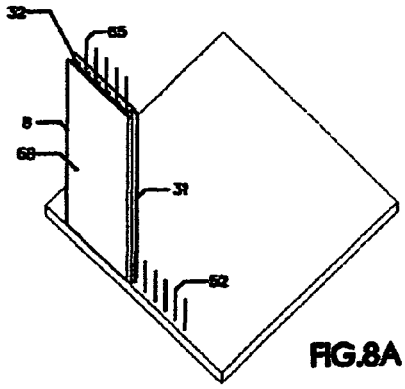
FIGS. 8A to 8C illustrate the use of a mold according to the instant invention in the construction of a concrete wall requiring joining of molds in order to build a large concrete wall.
Figure 8B:
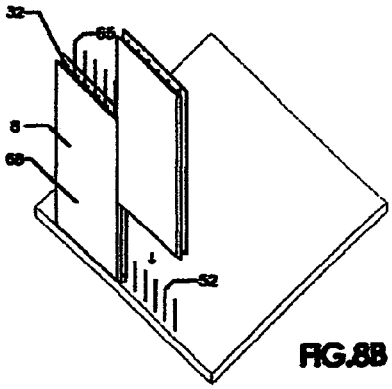
Figure 8C:
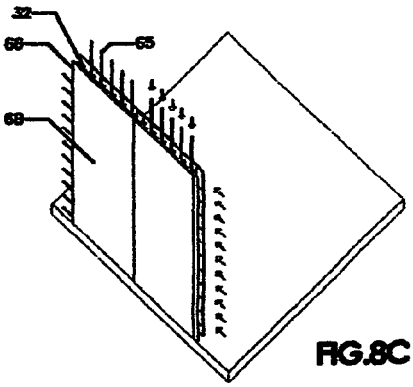

In operational terms, the mold embodiments 7, 8 and 9 are used in the construction of concrete or cement walls, houses, buildings and similar structures. FIG. 7 illustrates the assembled of mold embodiment 7 to a given structure site, wherein dowel 52 on construction site 53 is attached to the vertical re-bar 65 and wherein horizontally oriented re-bars 66 are resting on indentations 12 of holding units 10. Similarly, FIG. 8A to 8C illustrate the joining of two mold embodiments 8 in the construction of a larger size wall 68 by means of interconnecting unit 31 and wherein the distribution and accommodation of vertical re-bars 65 and horizontal re-bars 66 inside the internal cavity 32 of mold embodiment 8 are shown.

While the invention has been described in conjunction with some embodiments, it is to be understood that many alternatives, modifications, and variations will be apparent to those skilled in the art in light of the forgoing description. Accordingly, the invention is intended to embrace all such alternatives, modifications and variations falling within the spirit and scope of the appended claims.

What is claimed is:

1. A stay in place construction mold useful in the construction of concrete walls, said mold comprising:

(a) two fiber cement panels positioned parallel one to the other; each fiber cement panel having a flat substantially uniform external and internal surface and a plurality of pass-through openings;

(b) multiple holding units, said holding units comprising: a flat rectangular main body; an indentation substantially located at the center of the upper side of the flat rectangular main body; a left and right lateral edges having a completely flat outer surface perpendicularly located at and extending from the lateral sides of the rectangular body, a pass-through opening located on said flat surface of each one of the lateral edges, a lower edge perpendicularly positioned at the lower side of the bottom side of the flat rectangular main body, wherein each of said holding units are fastened to the internal surface of the fiber cement panels in a series of multiple columns, each of said column being apart from the others at a predetermined distance and each holding unit within a column being apart from the next holding unit at a predetermined distance, (c) fastening means for permanently connecting said holding units to said internal surface of said fiber cement panels via the pass-through openings located on said flat surface of each one of the lateral edges and the plurality of pass-through openings of said fiber cement panels.

2. The mold as recited in claim 1 further comprising a foam panel having the same dimensions of the fiber cement panels, being attached to the internal surface of one of the fiber cement panels and having a plurality of pass-through openings having a diameter corresponding to the height of said lateral edges.

3. The mold as recited in claim 1, further comprising two interconnecting fiber cement units located along a side edge of the internal section of said two fiber cement panels, respectively.

4. The mold as recited in claim 1, further comprising a closing unit that encloses an internal cavity defined by said two fiber cement panels by placing said closing unit at a side end of said two fiber cement panels.

5. The mold as recited in claim 1, wherein the fastening means is selected from the group of bolts and rivets, screws or flathead screw.

6. The mold as recited in claim 5, wherein the fastening means is a flathead screw.

7. The mold as recited in claim 1, wherein the holding units are made of metal.

8. The mold as recited in claim 7, wherein said metal is steel.

9. The mold as recited in claim 8, wherein said metal is galvanized steel.

10. The mold as recited in claim 1, wherein each of said plurality of pass-through openings of said two fiber cement panels comprises a first opening and a second opening coaxial to said first opening and having a diameter smaller than the diameter of said first opening.

* * * * *